US008405253B2

(12) United States Patent
McCoy

(10) Patent No.: US 8,405,253 B2
(45) Date of Patent: Mar. 26, 2013

(54) MECHANICALLY ENERGIZED ESERVICE CONNECTOR SYSTEM

(75) Inventor: Richard A. McCoy, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 576 days.

(21) Appl. No.: 12/643,148

(22) Filed: Dec. 21, 2009

(65) Prior Publication Data

US 2011/0148223 A1 Jun. 23, 2011

(51) Int. Cl.
*H01H 35/00* (2006.01)
*H01H 83/00* (2006.01)

(52) U.S. Cl. ..... 307/116; 709/204; 709/224; 709/225; 361/679

(58) Field of Classification Search ..... 307/116; 709/224, 225, 204; 361/679
See application file for complete search history.

(56) References Cited

U.S. PATENT DOCUMENTS

| | | | |
|---|---|---|---|
| 1,958,206 | A | 5/1934 | Rubsam |
| 3,101,984 | A | 8/1963 | Wieckmann |
| 3,258,553 | A | 6/1966 | Breslin |
| 4,148,536 | A | 4/1979 | Petropoulsos et al. |
| 4,591,732 | A | 5/1986 | Neuenschwander |
| 4,604,505 | A | 8/1986 | Henninger |
| 5,031,258 | A | 7/1991 | Shaw |
| 5,385,468 | A | 1/1995 | Verderber |
| 5,433,623 | A | 7/1995 | Wakata et al. |
| 5,713,752 | A | 2/1998 | Leong et al. |
| 6,176,718 | B1 | 1/2001 | Skarie et al. |
| 6,350,148 | B1 | 2/2002 | Bartolutti et al. |
| 6,359,270 | B1 | 3/2002 | Bridson |
| 6,428,334 | B1 | 8/2002 | Skarie et al. |
| 6,534,951 | B2 | 3/2003 | Kawashima |
| 6,559,882 | B1 | 5/2003 | Kerchner |
| 6,685,491 | B2 | 2/2004 | Gergek |
| 6,969,928 | B2 | 11/2005 | Hanson |
| 6,981,695 | B1 | 1/2006 | Hedlund et al. |
| 7,024,717 | B2 | 4/2006 | Hilscher et al. |
| 7,207,080 | B2 | 4/2007 | Hilscher et al. |
| 7,209,038 | B1 | 4/2007 | Deconinck et al. |
| 7,264,026 | B2 | 9/2007 | Gruber et al. |
| 7,291,032 | B1 | 11/2007 | Carver et al. |
| 7,354,292 | B1 | 4/2008 | Lloyd et al. |
| 7,404,298 | B2 | 7/2008 | Kim et al. |
| 7,493,926 | B2 | 2/2009 | Weglin |
| 7,584,030 | B1 * | 9/2009 | Graham ..... 701/33.3 |
| 7,618,295 | B2 | 11/2009 | McCoy |
| 7,625,246 | B2 | 12/2009 | McCoy et al. |

(Continued)

FOREIGN PATENT DOCUMENTS

| | | | |
|---|---|---|---|
| EP | 0868077 | A2 | 9/1998 |
| JP | 60033716 | A | 2/1985 |

(Continued)

*Primary Examiner* — Rexford Barnie
*Assistant Examiner* — Toan Vu
(74) *Attorney, Agent, or Firm* — Clifton G. Green; McGarry Bair PC

(57) ABSTRACT

A system for receiving an eService, such as a thermal service, an illumination service or an acoustic service, from an eService source. A service switch is provided for selectively transferring the eService from a host or other eService source to an eService consumer. The service switch is activated to transfer the eService from the eService source to the eService consumer in response to movement of a component associated with the eService source.

32 Claims, 7 Drawing Sheets

U.S. PATENT DOCUMENTS

| | | | | |
|---|---|---|---|---|
| 7,639,485 | B2 | 12/2009 | McCoy | |
| 7,651,368 | B2 | 1/2010 | Kendall et al. | |
| 7,686,127 | B2 | 3/2010 | LeClear et al. | |
| 7,713,090 | B2 | 5/2010 | Kendall et al. | |
| 7,740,505 | B2 | 6/2010 | McCoy | |
| 7,740,506 | B2 | 6/2010 | McCoy | |
| 7,748,494 | B2 | 7/2010 | LeClear et al. | |
| 7,751,184 | B2 | 7/2010 | McCoy | |
| 7,765,332 | B2 | 7/2010 | McCoy et al. | |
| 7,798,865 | B2 | 9/2010 | McCoy et al. | |
| 7,810,343 | B2 | 10/2010 | McCoy et al. | |
| 7,826,203 | B2 | 11/2010 | McCoy | |
| 7,841,907 | B2 | 11/2010 | McCoy | |
| 7,843,697 | B2 | 11/2010 | McCoy et al. | |
| 7,852,619 | B2 | 12/2010 | McCoy | |
| 7,865,639 | B2 | 1/2011 | McCoy et al. | |
| 7,869,201 | B2 | 1/2011 | McCoy et al. | |
| 7,870,753 | B2 | 1/2011 | Marcy, V et al. | |
| 7,871,300 | B2 | 1/2011 | McCoy et al. | |
| 7,898,812 | B2 | 3/2011 | McCoy et al. | |
| 7,903,397 | B2 | 3/2011 | McCoy | |
| 7,916,336 | B2 | 3/2011 | Silverbrook et al. | |
| 7,931,114 | B2 | 4/2011 | LeClear et al. | |
| 7,934,958 | B2 | 5/2011 | Kendall et al. | |
| 7,980,088 | B2 | 7/2011 | LeClear et al. | |
| 8,008,586 | B2 | 8/2011 | Kuehl et al. | |
| 8,035,958 | B2 | 10/2011 | Kendall et al. | |
| 8,040,666 | B2 | 10/2011 | McCoy et al. | |
| 8,151,016 | B2 | 4/2012 | McCoy | |
| 2003/0037447 | A1 | 2/2003 | Gruber et al. | |
| 2003/0154338 | A1 | 8/2003 | Boz et al. | |
| 2004/0036273 | A1 | 2/2004 | McClary | |
| 2004/0154318 | A1 | 8/2004 | Roh et al. | |
| 2005/0011205 | A1* | 1/2005 | Holmes et al. | 62/156 |
| 2006/0053655 | A1 | 3/2006 | Weglin | |
| 2006/0118694 | A1 | 6/2006 | Lee et al. | |
| 2006/0125360 | A1 | 6/2006 | Kim et al. | |
| 2006/0168236 | A1 | 7/2006 | Higuma et al. | |
| 2007/0086151 | A1 | 4/2007 | Oh et al. | |
| 2008/0065289 | A1* | 3/2008 | Bertosa et al. | 701/29 |
| 2008/0164224 | A1 | 7/2008 | McCoy et al. | |
| 2008/0164225 | A1 | 7/2008 | McCoy | |
| 2008/0164226 | A1 | 7/2008 | McCoy et al. | |
| 2008/0164227 | A1 | 7/2008 | LeClear et al. | |
| 2008/0164796 | A1 | 7/2008 | McCoy et al. | |
| 2008/0165282 | A1 | 7/2008 | Marcy et al. | |
| 2008/0165474 | A1 | 7/2008 | McCoy et al. | |
| 2008/0165475 | A1 | 7/2008 | McCoy et al. | |
| 2008/0165476 | A1 | 7/2008 | McCoy et al. | |
| 2008/0165478 | A1 | 7/2008 | McCoy | |
| 2008/0165505 | A1 | 7/2008 | McCoy et al. | |
| 2008/0165509 | A1 | 7/2008 | Kendall et al. | |
| 2008/0165998 | A1 | 7/2008 | LeClear et al. | |
| 2008/0166895 | A1 | 7/2008 | McCoy et al. | |
| 2008/0166915 | A1 | 7/2008 | Kendall et al. | |
| 2008/0168205 | A1 | 7/2008 | McCoy et al. | |
| 2008/0192411 | A1 | 8/2008 | McCoy | |
| 2008/0201032 | A1* | 8/2008 | Fayyad et al. | 701/29 |
| 2008/0222327 | A1 | 9/2008 | McCoy et al. | |
| 2008/0231464 | A1 | 9/2008 | Lewis et al. | |
| 2008/0231764 | A1 | 9/2008 | Kendall et al. | |
| 2008/0232053 | A1 | 9/2008 | Kendall et al. | |
| 2008/0247141 | A1 | 10/2008 | Kendall et al. | |
| 2008/0287009 | A1 | 11/2008 | McCoy | |
| 2009/0009316 | A1 | 1/2009 | Kendall et al. | |
| 2009/0047824 | A1 | 2/2009 | Seibert et al. | |
| 2009/0054804 | A1 | 2/2009 | Gharib et al. | |
| 2010/0120284 | A1* | 5/2010 | Oka et al. | 439/372 |
| 2010/0182753 | A1 | 7/2010 | Kendall et al. | |
| 2010/0248546 | A1 | 9/2010 | McCoy | |
| 2011/0049308 | A1 | 3/2011 | Beaman et al. | |
| 2011/0146328 | A1 | 6/2011 | Hendrickson et al. | |
| 2011/0146329 | A1 | 6/2011 | Kuehl et al. | |
| 2011/0146330 | A1 | 6/2011 | Kuehl et al. | |
| 2011/0146819 | A1 | 6/2011 | Hendrickson et al. | |
| 2011/0147159 | A1 | 6/2011 | Kuehl et al. | |
| 2011/0147160 | A1 | 6/2011 | Kuehl et al. | |
| 2011/0147161 | A1 | 6/2011 | Kuehl et al. | |
| 2011/0147417 | A1 | 6/2011 | Kuehl | |
| 2011/0148216 | A1 | 6/2011 | McCoy | |
| 2011/0148223 | A1 | 6/2011 | McCoy | |
| 2011/0148649 | A1 | 6/2011 | de Cavalcanti et al. | |
| 2011/0148650 | A1 | 6/2011 | Jenkins et al. | |
| 2011/0148651 | A1 | 6/2011 | Hendrickson et al. | |
| 2011/0149485 | A1 | 6/2011 | Kuehl et al. | |
| 2011/0152024 | A1 | 6/2011 | Kuehl | |
| 2011/0153739 | A1 | 6/2011 | McCoy | |
| 2011/0153821 | A1 | 6/2011 | McCoy | |
| 2011/0153871 | A1 | 6/2011 | Ferragut, II et al. | |
| 2011/0153880 | A1 | 6/2011 | McCoy | |

FOREIGN PATENT DOCUMENTS

| | | | |
|---|---|---|---|
| JP | 06310202 | A | 11/1994 |
| JP | 06310204 | A | 11/1994 |
| JP | 06333633 | A | 12/1994 |
| JP | 2007080584 | A | 3/2007 |
| WO | 2007/015274 | A1 | 2/2007 |

* cited by examiner

MECHANICALLY ENERGIZED ESERVICE CONNECTOR SYSTEM

BACKGROUND

Traditionally, appliances, consumer electronics devices, and other useful household equipment had been located in different rooms dedicated to the function supported by the appliance, consumer electronic device, and/or household equipment. The kitchen has traditionally been limited to a space for preparing and eating meals and consequently has mostly been occupied by cabinetry and large home appliances such as refrigerators, dishwashers, and ovens. The family room has been designated as a place for leisure activities, and so most entertainment devices, such as televisions and video games are commonly found here. Laundry rooms normally house a clothes washing machine, a clothes dryer, and an iron. Devices such as personal computers and printers are often located in another room, such as a dedicated home office or bedroom.

Consumers increasingly own multiple hand-held or portable consumer electronic devices, such as laptops, cell phones, PDA's, and digital music players. These devices are typically used in many different rooms in the house and are often carried from room to room throughout the home. Consumers tend to eat, meet and entertain in the kitchen, not just in the dining room and family room. In fact, the kitchen is often the hub of most household activity. Consumers also tend to work in every room of the home with the adoption of laptop computers and wireless networks. Therefore, there is a trend for consumers to perform non-traditional functions in a household room designed for a traditional function. The present invention recognizes this trend and attempts to support the trend.

BRIEF SUMMARY

The invention relates to eService connector systems for connecting accessory devices to a host.

According to one aspect of the invention, a system couples with a first eService communicating device having a first eService connector component, and comprises a second eService connector component connectable to the first eService connector component, a service switch operably connected to an eService source, the service switch operable for selectively communicating an eService between the first and second eService connector components, a first actuating link moveably associated with the service switch, and a second actuating link moveably associated with the second eService connector component and engageable with the first actuating link, wherein the service switch is selectively activated to communicate eService between the first and second eService connector components in response to movement of the second actuating link.

According to another aspect of the invention, a system receives an eService consumer comprising an eService connector, and comprises a first eService connector component operably engageable with a separate second eService connector component for transferring an eService from an eService source to the second eService connector component, and a service switch for selectively connecting the first eService connector component to the eService source, the service switch including a first actuating link engageable with a second actuating link associated with the second eService connector component, wherein the service switch is activated to transfer an eService from the eService source to the first eService connector component in response to movement of the second actuating link associated with the second eService connector component.

According to yet another aspect of the invention, an eService communicating device receives an eService from a host comprising a first eService connector component. The eService communicating device comprises a second eService connector component operably engageable with a separate first eService connector component for selectively receiving an eService from an eService source, and an actuator operably associated with the second eService connector component, the actuator moveable between at least a first position and a second position along a path generally parallel to an axis of insertion of the second eService connector component with the first eService connector component, wherein the eService is delivered to the second eService connector component when the actuator is in the first position.

According to still another aspect of the invention, an adapter removably couples an accessory having a first accessory eService connector component to a host having an eService provider, a first host eService connector component, and a service switch selectively providing an eService to the first eService connector. The adapter comprises a second host eService connector component engageable with the first host eService connector component, a second accessory eService connector component engageable with the first accessory eService connector component, an eService line operably interconnecting the second host eService connector component and the second accessory eService connector component for the transfer of an eService therealong, and a first actuating link engageable with a second actuating link associated with the service switch, wherein movement of the first actuating link activates the service switch.

DETAILED DESCRIPTION

Figure 1:
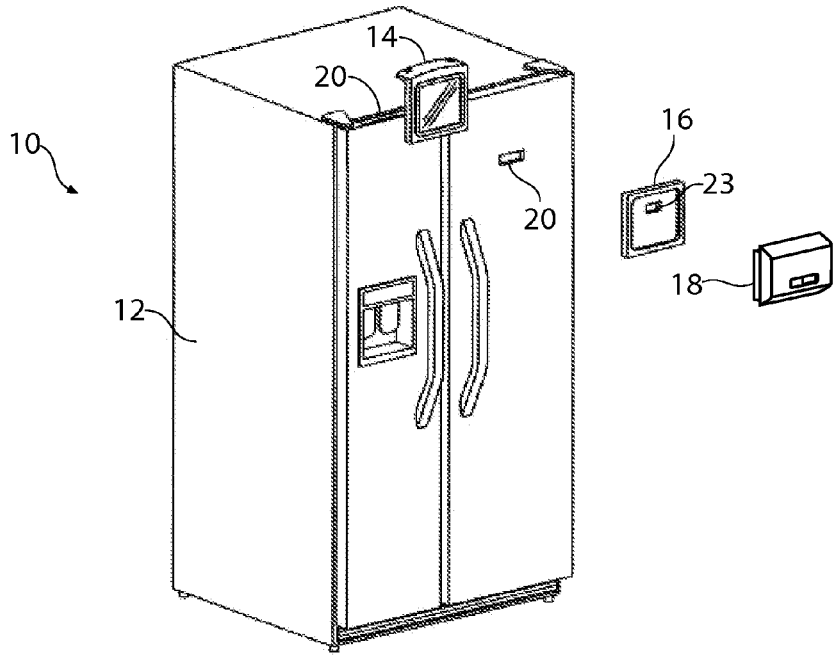
FIG. 1 is a perspective view of a modular system according to one embodiment of the invention employing a mechanically energized eService connector system for connecting an accessory device to a host.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or to otherwise limit or restrict the claims to the precise forms and configurations shown in the drawings and disclosed in the following detailed description.

The drawings and the following detailed description relate generally to systems of eService connector components for coupling an eService provider with an eService consumer.

In the drawings generally, a service provider within a host creates a first service, which is delivered to an eService transmitter. The first service may be delivered to the transmitter in any appropriate form, which may be used by the transmitter, such as in the form of electrical power, an electromagnetic wave, mechanical power, or a compression wave, for example. If the first service is an eService, the eService transmitter may simply transmit the eService as received or may modify it in form, such as frequency, type, intensity, polarity, etc. If the first service is not in the form of an eService, then the eService transmitter or another device between the service provider and the eService transmitter uses the first service to create the eService for transmission.

An eService receiver associated with an accessory device receives the eService and either consumes the eService, retransmits the eService, or provides a second service to a service consumer associated with the accessory device. If the service consumer is an eService consumer, then the eService receiver may simply retransmit or pass the received eService to the eService receiver or may modify it in form. If the service consumer is not an eService consumer, than the eService receiver or another device uses the eService to create the service used by the service consumer.

The following definitions apply to terms that may be used in the specification and the claims, unless otherwise noted.

As used herein, an "eService" is a useful wave-based functionality, such as thermal energy, illumination, and sound, which may be communicated from one device to another device. An eService may be provided continuously, for specified times, for specified amounts, and/or for the duration of certain events, such as the duration of a user function or a device operation, to provide sound, heat, cooling, or illumination.

A "service" is a useful functionality that may be communicated from one device to another device, and can include an eService, but can also include other useful functionalities such as electrical power, electronic data, mechanical support, mechanical power, mechanical motion, fluid power, or a substance, as well as others.

The term "coupled", and any variation thereof, as used herein, includes any type of connection that permits transfer of a service, such as an eService, between two devices. The term "coupled" does not require a physical connection between the two devices, so long as the coupling permits transfer of an eService. The term "coupled" includes both fixed and removable coupling, as well as both continuous and intermittent coupling.

The term "communication", and any variation thereof, as used herein, is the coupling of two devices to supply a service, including an eService, from at least one of the devices to the other of the devices, such as through directly connected electronic lines or plumbing lines, or through contactless communication (also referred to as contactless transmission). Contactless communication can include any types of contactless service communication, including, without limitation for illustration purposes, electromagnetic transmission, acoustical transmission, and magnetic fields. Service communication includes supplying or receiving any service. As used herein, communication of eService includes both uni-directional and multi-directional communication between any two devices, either directly, or through an adapter, as defined herein.

"EService communication" as used herein is the communication of an eService including any coupling of two devices to supply an eService from at least one of the devices to the other of the devices through a contact or contactless coupling, and includes acoustic, thermal and illumination communication.

"Illumination communication" as used herein is the coupling of two devices to supply illumination from at least one of the devices to the other of the devices, either contactlessly or through contacting components, such as through the coupling of two light pipes or a light transmitter and receiver combination such as opto-isolator.

"Acoustic communication" as used herein is the coupling of two devices to supply sound, compression waves, or vibration from at least one of the devices to the other of the devices, either contactlessly or through contacting components.

"Thermal communication" as used herein is the coupling of two devices to supply heating or cooling through radiation, conduction, or convection from at least one of the devices to the other of the devices, either contactlessly or through contacting components.

The terms "provide," and "supply" and any variation thereof, are used herein to denote a source of the service relative to a device receiving the service. Neither term is limited to the original source of the service. A device that provides or supplies a service may simply be passing on the service from the original source. For example, a device that provides an illumination service may pass on data it receives from a household network. However, the device may alternatively or additionally provide another eService that originates with the device, such as a heat service.

The term "receive" and any variation thereof, is used herein to denote receipt of a service relative to the device providing the service. The term is not limited to the ultimate consumer of the service. A device that receives a service may simply be passing on the service from the source, such as an appliance, to a device that will consume, as hereinafter defined, the service. The device which receives a service is not necessarily the end consumer of the service.

The term "consume" and any variation thereof, as used herein denotes the act of employing, using, storing, or dispensing at least a portion of the service received in connection with performing a function, such as using a power, illumination or acoustic service to operate a speaker or video display.

A "useful device" as used herein is a device that is capable of performing a useful physical or virtual function either alone or in combination with another device.

A "service consumer" as used herein is any useful device that employs, uses, stores, or dispenses a service in connection with performing a physical or virtual function. A service consumer may be, for example, a consumer electronic device, a remote user interface, a source of consumer information, a reader, such as a bar code, optical scanner or RFID reader, a sensor device, a smart utensil, a portable appliance, an additional smart coupling device, a remote controller, a network binder, a cycle accessory, a resource controller, such as an energy controller, a communicator, such as an audible accessory, an access or payment system, such as a smart card system permitting access to a host device, a sales demonstration device, an eService holder, such as a battery, a dispenser, a media content holder, a resource controller, such as a water controller, a dispenser, a filter, a water filter, an air filter, a detergent dispenser, a drink dispenser, a detergent cartridge, a substance holder, such as a bottle, a jug, or a cycle accessory.

An "eService consumer" as used herein is any service consumer that employs, uses, stores, or dispenses an eService to provide or enhance visibility or a device using a thermal service to change or maintain a temperature for a container or a substance.

A "service provider" as used herein is any device that is capable of providing or supplying a service to another device.

An "eService communicating device" as used herein is any device that is capable of communicating an eService with another device, and may be an eService provider or an eService consumer.

A "host" as used herein is a service provider that has a primary function independent of providing a service. For example, the host may be an appliance and the primary function can be performing a series of steps to conduct a useful cycle of operation. The appliance may be a conventional household appliance, such as a refrigerator performing a cooling cycle or an ice making cycle. Other examples of appliances that may be hosts include, but are not limited to, a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus, or any combination thereof. Alternatively, the host may be a fixture such as a water softener, a water heater, a furnace, pool water treatment equipment, or an HVAC system. The host may be a small device such as a thermostat, a blender, a mixer, a toaster, a coffee maker, a trash compactor, an air purifier, an iron, a vacuum cleaner, or a robot. The host can alternatively comprise a structural feature of a building, such as a wall, cabinet, or door. The host may be a service consumer in addition to being a service provider. For example, the host may provide an illumination service while receiving or while supplying and receiving a data service.

As used herein, the terms "accessory" or "accessory device" refer to any useful device that may be used primarily in conjunction with a host to enhance, supplement, regulate or monitor the functionality of the host. An accessory device may be a service provider, a service consumer, or both. Examples of an accessory device include, but are not limited to, a television, a video camera, a video recorder, a personal computer, a notebook computer, a computer monitor, a video display, a keyboard, a printer, copying equipment, a calculator, a facsimile machine, a scanner, a digital storage device, a wireless transceiver, an internet router, a power supply, a data recorder, an answering machine, a telephone, a cordless telephone, a cellular telephone, a video game system, a personal digital assistant, a DVD player, a VHS player, a VCR, a cassette deck, an 8 mm video player, a CD player, a Blackberry®, a smartphone, a smoke detector, a portable digital video player, an MP3 player, a radio, other music players, an audio speaker, a digital picture frame, a weather station, and a scale or balance.

A "portable device" as used herein is a useful device that is designed to be moveable by a user during its useful life between a use location and a storage location or alternative use location. A portable device can be an accessory device.

An "independent device" as used herein is a useful device that provides a useful function without being connected to a service provider. In some cases, the primary function of the independent device is different from the primary function of a host from which the independent device may receive a service. The independent device may be a consumer electronic device, such as portable communication, entertainment, informational or educational devices.

A "dependent device" as used herein is a useful device that provides a useful function only when connected to a service provider. A dependent device may be a service consumer. Examples of dependent service consumers that may be coupled to a host include a remote user interface (UI), a consumable reader, a cooking sensor, a smart pan or pot, a smart dimmer, a cycle accessory, an energy controller, an audible accessory, a laundry payment or smart card system, a sales demonstration unit, or a service laptop or other service client.

A "service connector system" as used herein is a connector system having at least two separate service connector components, each associated with a useful device. The service connector components cooperate with one another to couple the useful devices to facilitate communication of a service between the useful devices. A service connector system that facilitates communication of an eService between useful devices may alternately be referred to as an "eService connector system". A service connector system may carry multiple services, including multiple eServices or an eService and another service, such as power or substance.

A "switched service connector system" as used herein is a service connector system having a switching capability in at least one of the service connector components operable to selectively permit the communication of a service between the components of the service connector system. If the service connector system is an eService connector system, the switched service connector system may alternately be referred to as a "switched eService connector system".

A "service switch" as used herein is any component used to selectively permit the communication of a service between components of a service connector system. A service switch may be associated with more than one type of service. For example, an electromagnetic service switch may be associated with, integrated with, or comprise a service switch or may be independent of a service switch. A service switch that permits communication of an eService may alternately be referred to as an "eService service switch".

A "plug" as used herein is a generally male service connection component.

A "receptacle" as used herein is a generally female service connection component.

A "service line" or "service pathway" as used herein is a pathway for transferring a service from one location to another. The service line may have any of a variety of configurations depending on the type of service being transferred, including but not limited to a pipe, a conduit, a wire, a tube, a channel, and a fiber optic cable.

An "eService line" or "eService pathway" as used herein is a service line or pathway for transferring an eService from one location to another. The eService line may have any of a variety of configurations, including but not limited to a pipe, a conduit, a wire, a tube, a channel, and a fiber optic cable. For example, for thermal service communication, an eService line may include a tube, a passageway, or a conductive path such as metal bar or heat pipe, or may include a radiation heat source and a radiation heat absorber. For illumination, an eService line may be a light pipe or a light sender and receiver. For acoustic service communication, an eService line may include a vibration conductive tube or wire, or may be a speaker and a microphone.

An "eService transmitter" as used herein is any device capable of receiving an eService from an eService provider and providing it to another device in the form of a wave.

An "eService receiver" as used herein is any device capable of receiving an eService in the form of a wave and consuming the eService or passing the eService to an eService consumer.

"Wireless" refers to a type of communication in which power and/or data is transferred over a distance without the use of electrical conductors or wires. For example, electromagnetic waves, light waves, or acoustic waves can be used to carry power and/or data over a distance without using electrical conductors or wires.

A "proximity target" as used herein is any component or device that may be detected when positioned within range of an associated proximity sensor, defined below. A proximity target may be passive, such as visual target or a magnetic target formed of magnetic or magnetic responsive material. Other examples of passive proximity targets may include a conductive component or surface capable of cooperating with a magnetic field, a current, or a voltage provided by a proximity sensor. A proximity target may alternatively be active or powered such as an electromagnet, a generator of a magnetic field, a current, a voltage or an acoustic wave. An active proximity target may alternatively provide a powered readable display or dispense a detectable chemical.

A "proximity sensor" as used herein is any component or device that may detect an associated proximity target when the proximity target is within a range of the proximity sensor. A proximity sensor may detect, for example, a change in an electromagnetic field, an electromagnetic wave, an acoustic wave, a visual target, a chemical component, an electrical signal, a change in voltage, a change in current, a change in frequency, a change in resistance, a change in inductance, a change in capacitance, a mechanical signal, a change in pressure, a displacement, a vibration, and the presence of a chemical. A proximity sensor may be active or passive, such as a magnetic sensor of magnetic or magnet responsive material, or may alternatively be active. Examples of active sensors include active magnetic sensors, light sensors, optical sensors, acoustic sensors, electromagnetic sensors, chemical sensors and thermal sensors. Examples of magnetic sensors include magnets and magnetic responsive components. Examples of optical sensors include infrared sensors, photoelectric sensors, fiber optic sensors, photo resistors, photovoltaic sensors, photo diodes and cameras. Examples of electromagnetic sensors include radio receivers, radar sensors, Hall Effect sensors, inductive sensors, capacitive sensors, variable reluctance sensors and eddy current sensors. Examples of acoustic sensors include ultrasonic sensors and microphones. A contact proximity sensor detects a proximity target by touching the proximity target. A contactless proximity sensor detects the proximity target through a wireless or contactless means. For example, magnetic flux can be used as the signaling mechanism between a contactless proximity sensor and a contactless proximity target.

As used herein, the term "proximity system" is a system that uses a "proximity switch" operated by a plurality of "proximity coupling components," each associated with a different parent device, for determining that the parent devices are in proximity with each other. Parent devices are usually paired, examples of which include a service provide and a service consumer, a host and an accessory, and a host and an adapter. Proximity coupling components may include a proximity target associated with one parent device to actively or passively provide an indication of the presence of the one parent device, and a proximity sensor associated with the other parent device that is responsive to the presence of the proximity target to activate the proximity switch. The proximity switch may be used to provide a signal or message indicative of the proximity of two parent devices, or may directly or indirectly regulate the flow of a service along a service line. The proximity systems disclosed herein employ contact proximity systems, wherein the proximity target and proximity switch use physical contact to detect the proximity of the two parent devices.

An "adapter" as used herein is an intermediate device that may be provided between a first and second useful device, such as between a host and an accessory, to facilitate the communication of services between the first and second useful devices. An adapter may receive a service from the first useful device and provide a modified version of the service to the second useful device, for example, by providing an electrical power service using a different voltage or providing a data service using a different data structure or signal type. In some applications, multiple adapters may be interposed between two accessory devices. In other applications, three or more devices may be coupled to a single adapter, such as between a host and two accessories. In some applications, the adapter may itself be an accessory device providing a useful function not provided by the accessory devices coupled to it. An adapter may optionally include a transformative component that transforms a service from a service provider to a different service, which is supplied to a service consumer. This may be useful when the service from the service provider is not compatible with the service consumer. The transformative component can be configured to transform the service into a compatible form for the service consumer. Examples of transformative components are protocol converters, power transformers, or other devices that convert substance, energy, or data from a first form to a second form.

A "functional unit" as used herein is any adapter coupled to a useful device, which together provide functionality that neither the adapter nor the useful device can alone provide. Any functional unit itself is also included within the meaning of the term "useful device". In some cases, it is contemplated that a dependent device may be coupled with an adapter that provides one or more eServices required by the dependent device to enable the functional unit to provide a useful function, in which case the functional unit also constitutes an independent device.

A "storage device" as used herein is any device capable of receiving an eService, storing the eService, and selectively dispensing the eService. A storage device may include, for example, a battery, a capacitor, a hard disk drive, an optical disc, such as CD, DVD, or Blue-ray Discs, a floppy disk, a ZIP disk, a minidisk, a solid state semiconductor memory, such as xD-Picture card, a MultiMediaCard, a USB flash drive, SmartMedia, an SD card, a miniSD card, an SDHC card, a microSD card, a TransFlash card, a CompactFlash I or II, a Secure Digital, or a Sony Memory Stick.

A "conversion device" as used herein is any device capable of converting the form of an eService or converting one eService to another eService. Examples of a conversion device include, but are not limited to, a generator, a motor, a piezoelectric device, a pneumatic device, an inverter, a lens, a filter, a prism, a transmitter, a speaker, and a resonator.

Figure 2:
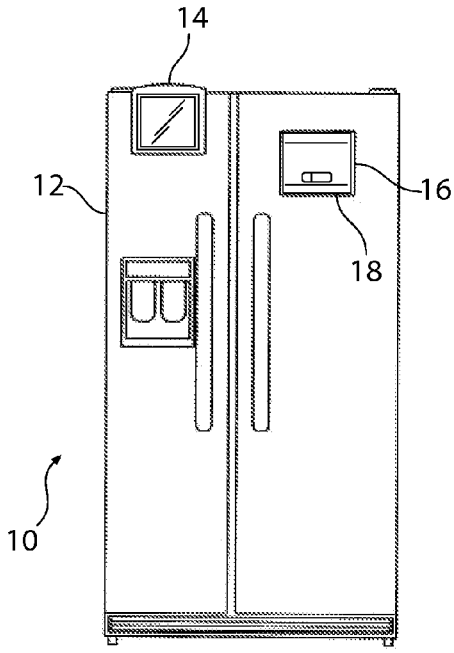
FIG. 2 is a front elevational view of the modular system of FIG. 1 showing the accessory device attached to the host.
Figure 3:
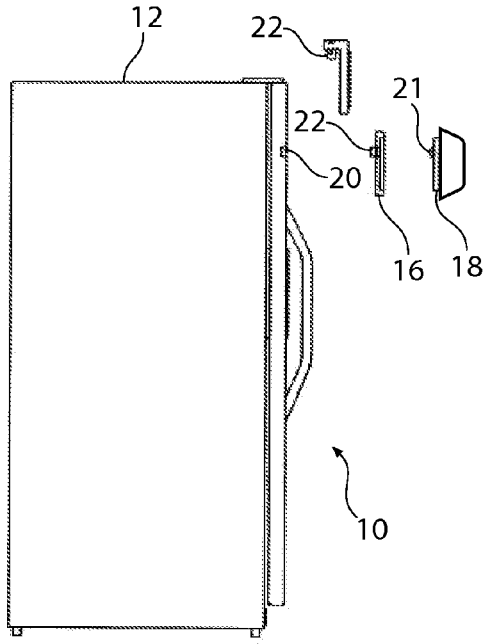
FIG. 3 is a side elevational view of the modular system of FIG. 1 showing the accessory device removed from the host.

Referring now to FIGS. 1-3, a schematic illustration of a modular system 10 according to one embodiment of the invention is shown to include at least one host 12 and at least one accessory device 14 that can be coupled to host 12.

The accessory device 14 may be either directly or indirectly coupled to host 12. Direct coupling occurs when accessory device 14 includes an eService connector component suitably configured for engaging a corresponding eService connector component of host 12 to establish an eService pathway between the host 12 and the accessory device 14. The eService pathway provides an eService line for transferring at least one eService from host 12 to accessory device 14 and from accessory device 14 to host 12.

An adapter 16 can be provided for coupling a second accessory device 18 having an incompatible eService connector component to host 12. An eService connector component is incompatible if it cannot be directly coupled to a corresponding eService connector component, such as when the incompatible eService connector component lacks certain physical features that would enable the eService connector component to engage the corresponding connector to establish an eService pathway. Adapter 16 may include an eService connector component that can be directly coupled with the eService connector component of host 12 and a second eService connector component that can be directly coupled with the incompatible eService connector component of accessory device 18, thereby establishing an eService pathway between host 12 and accessory device 18.

Although accessory device 14 is shown coupled to an upper surface of host 12, whereas accessory device 18 is shown attached to a front surface of host 12 by way of adapter 16, it shall be appreciated that in practice, accessory device 14 and adapter 16 may be suitably configured for coupling to host 12 in any desired location and manner in order to accommodate the design and performance requirements of a particular application.

Host 12 may perform a primary function. As illustrated herein, host 12 is a refrigerator performing a cooling cycle or an ice making cycle. Although the figures show an appliance comprising a refrigerator, it shall be understood that the invention is not limited to refrigerators or appliances in general.

Accessory devices 14 and 18 may also perform at least one primary function. The primary function of accessory devices 14 and 18 will likely be different from the primary function performed by host 12, although it need not be. In the embodiment illustrated in the drawing, accessory device 18 may, for example, be a display selectively illuminated by an illumination service provided by host 12 or having a speaker selectively activated by an acoustical service provided by host 12 to provide information to a user. Alternatively, for example, accessory device 18 may be a substance holder, such as a dispenser, which contains a substance that is selectively heated by a thermal service provided by host 12.

Host 12 can be configured to provide or receive at least one eService to or from accessory devices 14 and 18. Similarly, accessory devices 14 and 18 may also be configured to provide or receive at least one eService to or from host 12. It is not necessary that the eService transferred between host 12 and accessory devices 14 and 18 be used in performing the primary function of host 12 or accessory devices 14 and 18, or otherwise be related to the primary function of either device.

As mentioned previously, in instances where the accessory device includes an incompatible eService connector component that prevents direct coupling of the accessory device to host 12, adapter 16 may be provided for indirectly coupling the accessory device to host 12. Adapter 16 operates to establish an eService pathway for transferring the desired eService between host 12 and accessory device 18 having the incompatible eService connector component. Adapter 16 may alternatively communicate a first type of service with host 12 and a second type of service with accessory device 18. For example, adapter 16 may receive electrical power service from host 12 and use that to create illumination service for accessory device 18 or receive electrical and thermal service from host 12 and use that to provide a substance to accessory device 18.

Accessory devices 14 and 18 and host 12 may each be eService communicating devices. At least one eService can be supplied to accessory devices 14 and 18 from host 12, or from accessory devices 14 and 18 to host 12. The supply of the eService can be uni-directional in that either host 12 supplies the eService to accessory devices 14 and 18 or accessory devices 14 and 18 supply the eService to host 12. The supply of the eService can also be bi-directional in that the supplied eService can be delivered from host 12 to accessory devices 14 and 18 and from accessory devices 14 and 18 to host 12.

Figure 4:
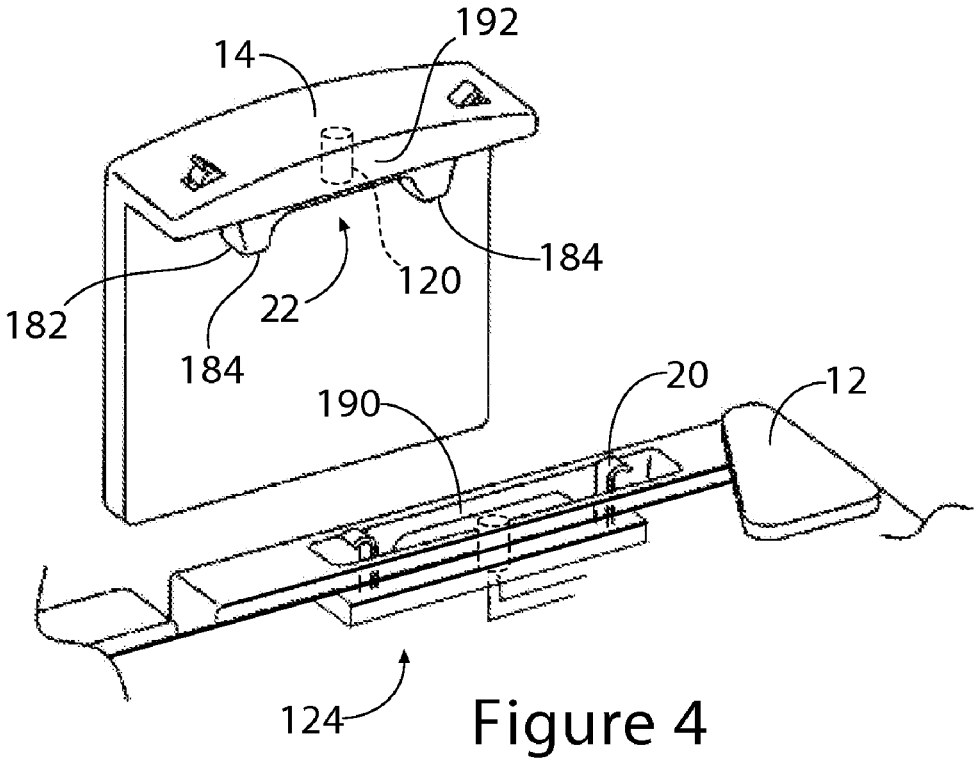
FIG. 4 is a partial top rear perspective view of the modular system of FIG. 1 with the accessory device removed from the host, showing a host portion of the mechanically energized eService connector system with portions shown schematically.
Figure 5:
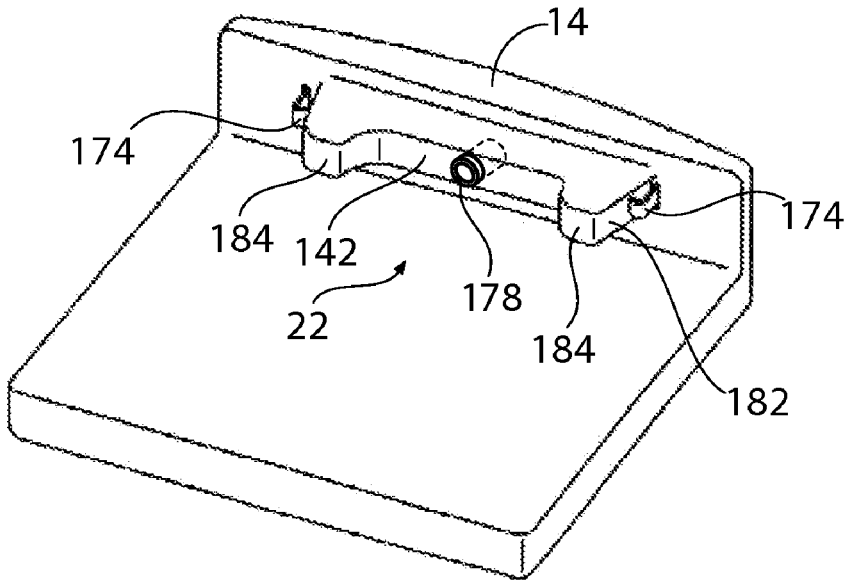
FIG. 5 is a bottom perspective view of the accessory device of FIG. 1 showing an accessory device portion of the mechanically energized eService connector system.

Referring additionally to FIGS. 4 and 5, host 12 and accessory device 14 may each be associated with at least one eService connector component, respectively referred to herein as a host eService connector component 20 and a device eService connector component 22. In the exemplary embodiment illustrated, host 12 comprises an eService provider and accessory device 14 comprises a portable eService consumer that functions as an accessory to host 12.

Host eService connector component 20 and device eService connector component 22 have complementary configurations that enable the eService connector components to be coupled to one another, thereby establishing an eService pathway over which desired eServices can be transferred between host 12 and accessory device 14. In instances where the accessory device includes an incompatible eService connector component, device eService connector component 22 may be included in an adapter, such as adapter 16. As illustrated, the adapter 16 has a first device eService connector component 23 for engagement with a device eService connector component 21 of the accessory device 18, as well as a second device eService connector component 22 for connection with a second host eService connector component 20 of the host 12. As a consequence, device eService connector components 22 may have the same general configuration whether included as part of accessory device 14 or adapter 16, and host eService connector component 20 may have the same general configuration whether it couples directly with an accessory device or an adapter. Accordingly, for purposes of discussion, the various features and operation of eService connector components 20 and 22 will hereinafter be described in connection with accessory device 14, but it shall be appreciated that device eService connector components 20 and 22 may also be used in conjunction with adapter 16.

Host eService connector component 20 can be integrally formed with host 12 or may be an add-on device. For purposes of discussion, host eService connector component 20 is shown integrally formed with host 12. When configured as an add-on device, host eService connector component 20 may also function as an adapter to enable a host and an accessory device having dissimilar eService connector components to be indirectly coupled to one another. Host eService connector component 20 may be removable or non-removable from host 12. Host eService connector component 20 can be configured to transfer or receive a single eService or multiple services.

Device eService connector component 22 may be integrally formed with accessory device 14 or may be an add-on component. For purposes of discussion, device eService connector component 22 is shown integrally formed with accessory device 14. When configured as an add-on component, device eService connector component 22 may also function as an adapter to enable a host and an accessory device having dissimilar eService connectors to be indirectly coupled to one another. Device eService connector component 22 may be removable or non-removable from accessory device 14. Similarly, device eService connector component 22 can be configured to transfer or receive a single eService or multiple services.

Figure 6:
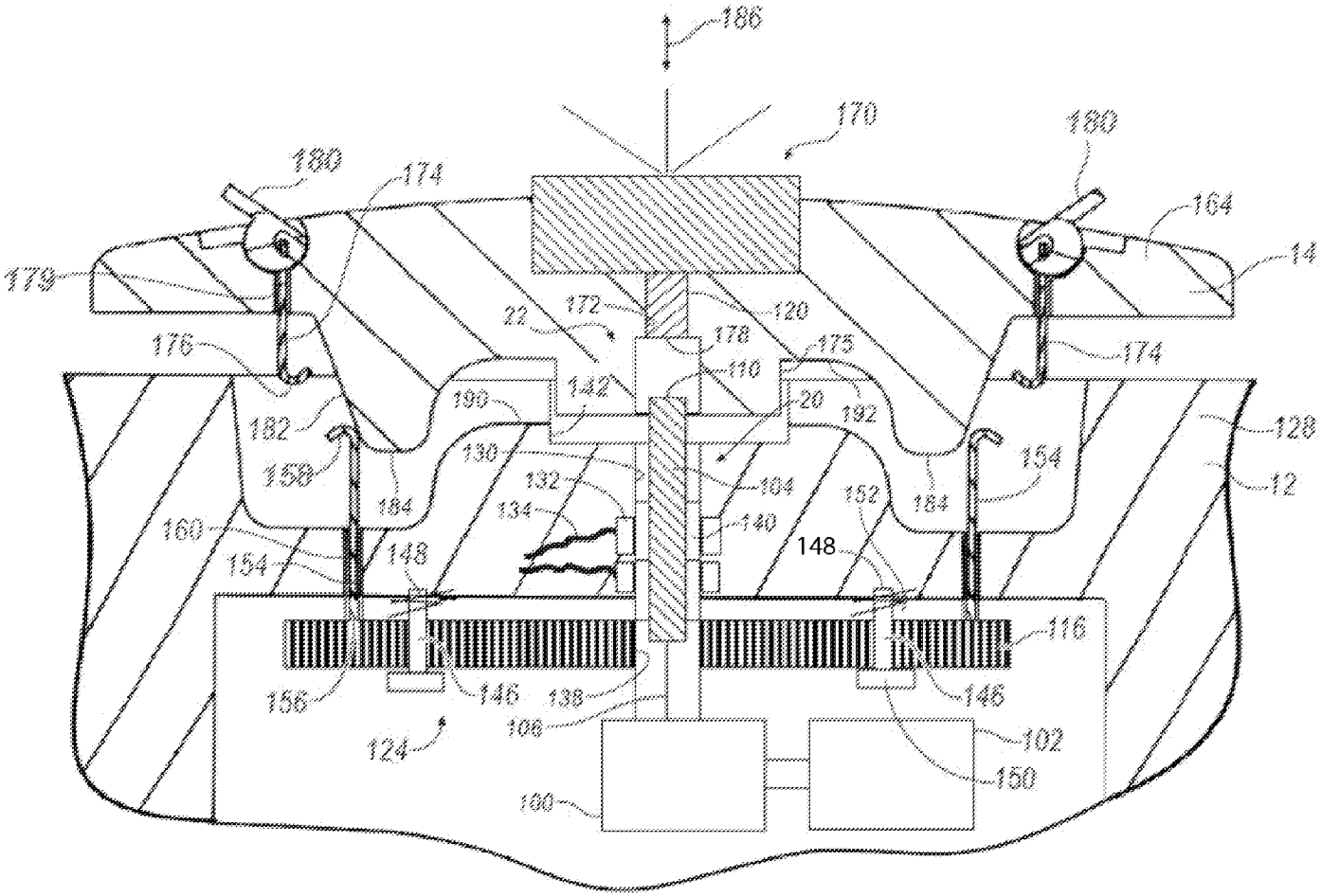
FIG. 6 is a partial cross-sectional view of the mechanically energized eService connector system of FIG. 1 showing the accessory device portion of the eService connector system positioned for engagement with the host portion of the eService connector system.
Figure 7:
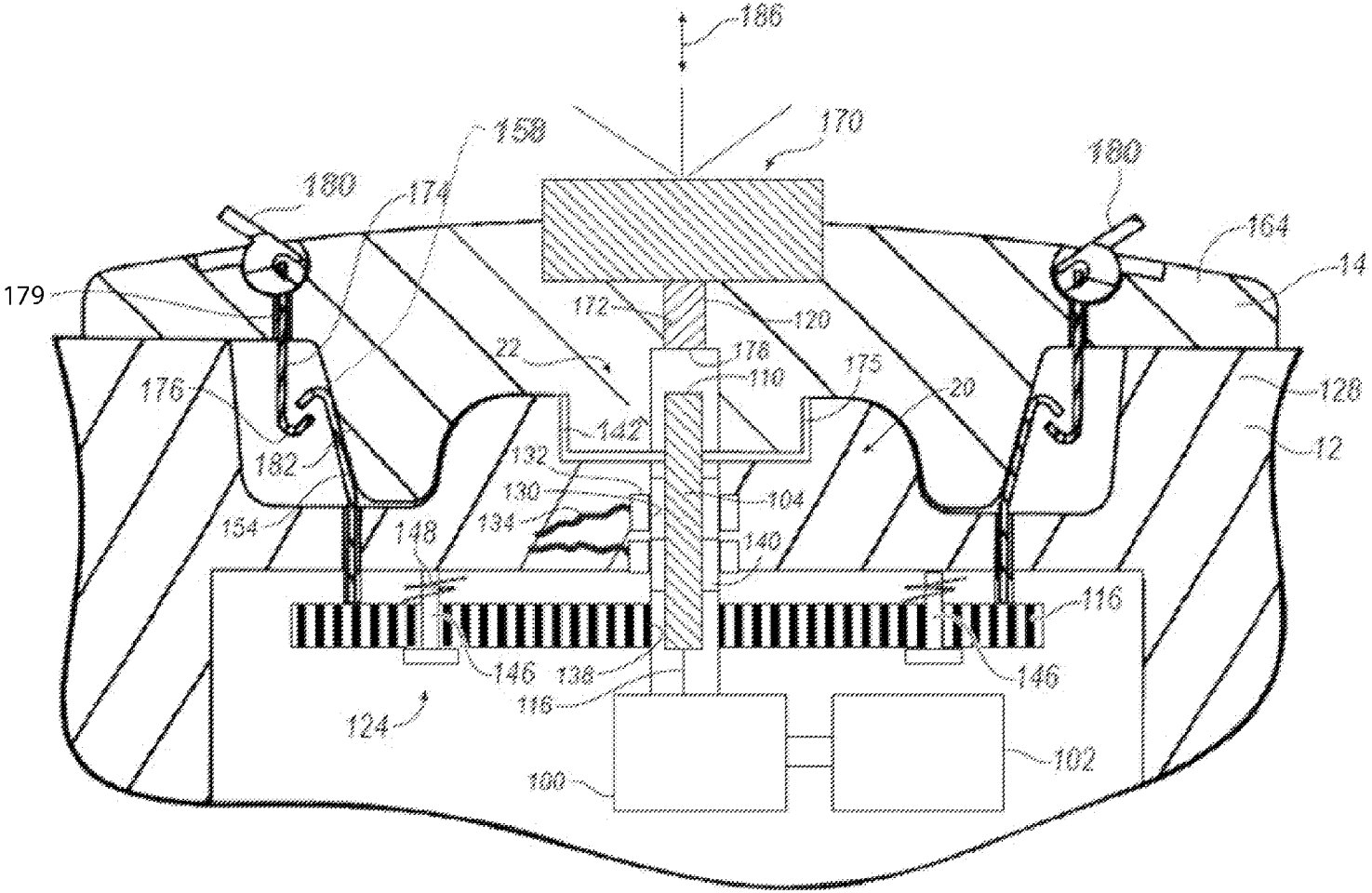
FIG. 7 is a partial cross-sectional view similar to FIG. 6 showing the accessory device portion of the eService connector system engaged with the host portion of the eService connector system and the eService connector system arranged in an unlatched state.
Figure 8:
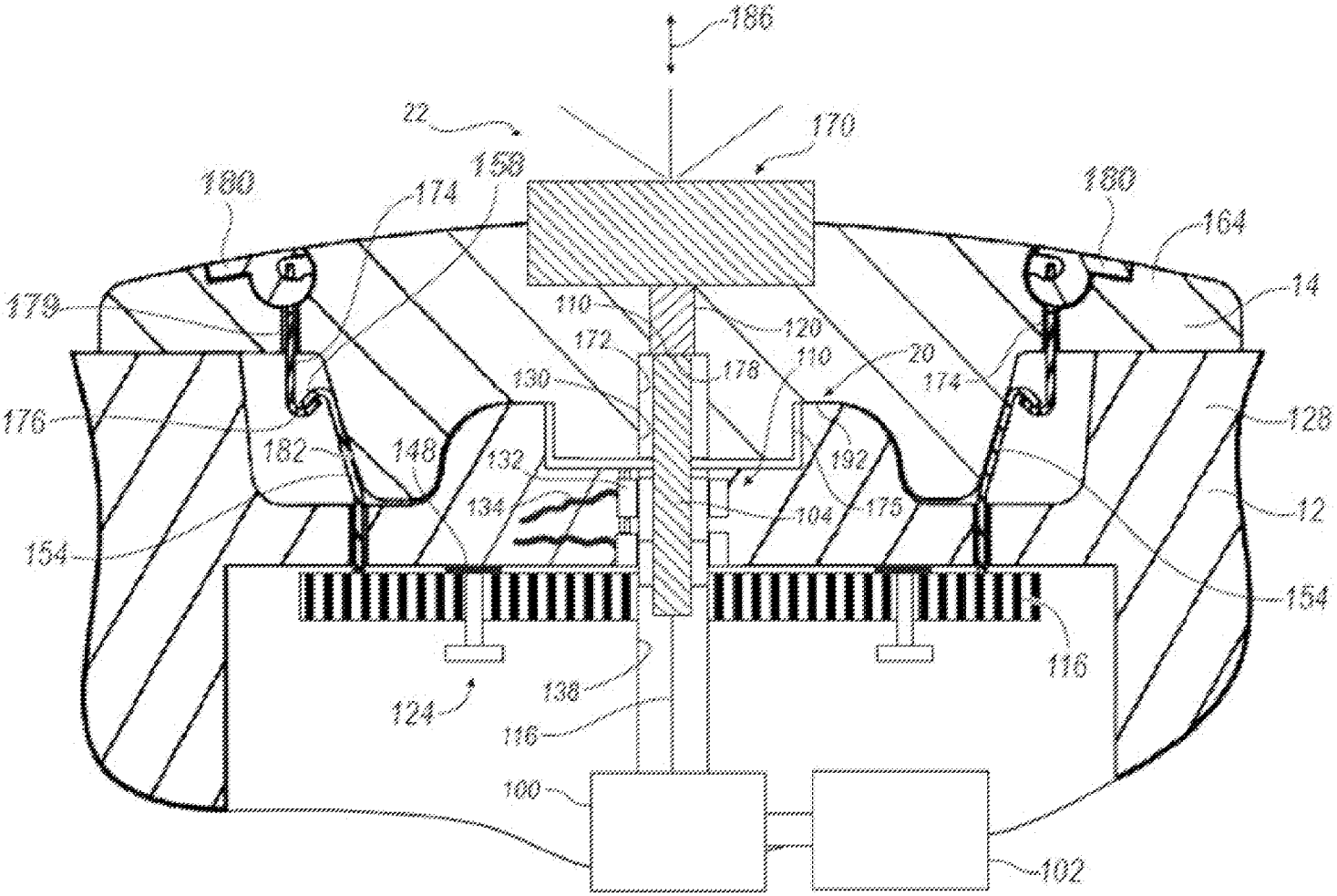
FIG. 8 is a partial cross-sectional view similar to FIG. 6 showing the accessory device portion of the eService connector system engaged with the host portion of the eService connector system and the eService connector system arranged in a latched state.

Referring to FIGS. 6 through 8 generally, host 12 may be associated with an eService provider 100 for selectively providing an eService to host eService connector component 20 for delivery to device eService connector component 22. Accessory device 14 may similarly be provided with an eService consumer 170 capable of using the eService delivered to device eService connector component 22.

EService service provider 100 is powered by an electrical power supply and controller 102 and uses the electrical power to create a first service. It will be appreciated that the power supply and controller 102 or eService provider 100 may be integrated into host 12 or provided in other devices in communication with host 12. The first service is supplied by eService provider 100 to an eService communicating component, such as an eService transmitter 104, by way of a service line 106.

EService provider 100 may be any type of eService provider and the first service may be any eService directly transmitted by eService transmitter 104. For example, eService provider 100 may be a thermal service provider 200 (see FIG. 9), and service line 106 and eService transmitter 104 may be heat conductive rods or wires. EService provider 100 may alternatively be an acoustic service provider 300 (see FIG. 10), and service line 106 and eService transmitter 104 may be sound conductive rods or wires. EService provider 100 may alternatively be an illumination service provider 400 (see FIG. 11), and service line 106 and eService transmitter 104 may be light pipe. These eService providers 200, 300 and 400 will be described later herein.

With continued reference to FIGS. 6 and 7, it will be appreciated that, in addition to a eService provider 100 being a potential provider of sound, illumination or heat, eService provider 100 may be a source of data, such as a source of fiber optic data, and a switch such as a fiber optic switch, for enabling the exchange of the fiber optic data between two eService communication devices.

It will further be appreciated that service line 106 or eService transmitter 104 may comprise a portion of the eService provider 100 by, for example, incorporating cal-rods, LEDs, sound generators, image generators, hologram generators, or other wave generating or transmitting features governed by eService provider 100. In the case of a sound generator, eService provider 100 may be source of acoustic information using DTMF tones or Morse code for transmission, thereby creating an acoustic data network when service switch 124, described later, is actuated. In the case of an image generator, eService provider 100 may project an image, such as a "smiley face". In this case, eService transmitter 104 might be a translucent film, which has the smiley face image encoded on it such that when service switch 124 is actuated, eService provider 100 supplies light through an eService transmitter 104, thereby causing the image to be projected to an eService communication device such as accessory device 14.

Alternatively, eService provider 100 may be a different type of service provider, such as an AC to DC converter, providing a first service to eService transmitter 104. In this instance, eService transmitter 104 may function as both an eService provider and as an eService transmitter by using the first service, such as direct current electrical power, to create an eService, such as by heating a heat conducting wire, generating light and sending it into a light pipe, or generating an acoustical wave and sending it along a vibration conducting rod.

As illustrated, the host 12 has a housing 128. Housing 128 may be an integral part of host 12 or may be a separate component. For purposes of discussion, housing 128 is illustrated as an integral part of host 12. EService transmitter 104 has an exposed end 110 extended through a bore 130 in housing 128 and into an enlarged counter bore 142 formed in the outwardly facing portion of housing 128. Enlarged counter bore 142 acts as a receptacle for a plug associated with accessory device 14, as will be described below. Where appropriate and practical for the type of service line 106, service line 106 may have a sliding engagement with eService transmitter 104 or with service provider 100, or may be flexible to permit some relative movement between eService transmitter 104 and eService provider 100. A biasing means (not shown), such as a spring, may be provided to bias eService transmitter 104 away from eService provider 100 to facilitate proper engagement of eService transmitter 104 with an eService receiver 120 when the eService connector components 22 and 20 are engaged.

As mentioned above, accessory device 14 has an eService consumer 170 and an eService receiver 120. EService receiver 120 is shown schematically in FIGS. 6, 7 and 8 has a rod-like structure coupled directly to eService consumer 170 that directly uses the eService. EService consumer 170 may be any type of service consumer and the first service may be any eService directly transmitted by eService transmitter 104.

For example, if eService receiver 120 receives an illumination service, eService receiver 120 may be a light pipe and eService consumer 170 may be a light conductive device illuminated by the receipt of the illumination service from eService receiver 120 to provide an illuminated display for a user. If eService receiver 120 receives an acoustic service, eService consumer 170 may be a speaker amplifying and re-broadcasting sound to a user. If the eService receiver 120 is a thermal service receiver, eService consumer 170 may be a heat conductive surface or a heat conductive wire directing the thermal service, for example, to the contents of a substance holder such as a bottle or a storage compartment.

It should be noted that the generically illustrated configuration is not intended to depict any particular configuration, but rather schematically represents a variety of potentially different configurations. In practice, the actual configuration will likely vary depending on, at least in part, the type of eService being transferred, space and power requirements, and manufacturing considerations. For example, acoustical transmission may require more contact surface area at coupling points such as between transmitter 104 and eService receiver 120 at the ends of service line 106 and between eService receiver 120 and eService consumer 170.

It should also be noted that, while the embodiment shows eService consumer 170 directly coupled to eService receiver 120 and using the eService as received by eService receiver 120, other configurations are contemplated.

Alternatively, where appropriate, a service line (not shown) may be provided between eService receiver 120 and eService consumer 170. For some applications, a conversion device (not shown) may be provided between eService consumer 170 and eService receiver 120 converting the output of eService receiver 120 to a service that may be used by eService consumer 170. Alternatively, a conversion device may be incorporated into eService receiver 120 or eService consumer 170. For example, a converter may be provided to convert illumination containing data into an electromagnetic service carrying data. EService consumer 170 may consume the eService for an internal operation of accessory device 14 or may relay the eService or a converted service to a second accessory device, such as accessory device 18 (see FIGS. 1-3). In still another instance, eService consumer 170 may be a component of an accessory device 18, which is only coupled to eService receiver 120 when accessory device 18 is removably coupled to accessory device 14.

EService receiver 120 extends through a bore 172 in a plug 175 formed on an external surface of a housing 164 of accessory device 14 and terminates in an exposed end 178 engageable with exposed end 110 of eService transmitter 104 for the selective communication of eService therebetween. Plug 175 is proportioned to fit inside the receptacle formed by enlarged counter bore 142 in housing 128 of host 12 when accessory device 14 is coupled with host 12.

Host eService connector component 20 may include a mechanically actuated service switch 124 that can be selectively actuated to establish an eService pathway between host 12 and accessory device 14 when accessory device 14 is coupled to host 12. In addition, host eService connector component 20 and device eService connector component 22 may also provide a mechanism for mechanically securing accessory device 14 to host 12, as shown in FIG. 6.

Service switch 124 may be enclosed within housing 128. Service switch 124 includes a switch plate 116 movable between an open position, shown in FIGS. 6 and 7, and a closed position, shown in FIG. 8, in a manner to be described later in detail, to enable an eService to be selectively transferred between host 12 and accessory device 14 by engagement of eService transmitter 104 with eService receiver 120 when accessory device 14 is coupled to host 12. EService switch plate 116 is generally disposed in the open position when accessory device 14 is decoupled from host 12.

EService transmitter 104 extends through an aperture 138 in switch plate 116 and is attached to switch plate 116, by any suitable attachment method to be selectively movable by switch plate 116. EService transmitter 104 extends from switch plate 116 into bore 130 and through housing 128 such as to be moved freely by switch plate 116 along a length of bore 130.

A proximity sensor, such as electrical contacts 132, may be provided in housing 128 and extend into bore 130 to sense the position of eService transmitter 104. Each of the electrical contacts 132 may be connected by an electrical line 134 to a control circuit, not shown, responsive to the creation of an electrical connection between contacts 132 to provide a control signal to power supply and controller 102 to selectively power to the eService provider 100 or to otherwise regulate the operation of eService provider 100. In one possible configuration, housing 128 may be made of dielectric material and electrical contacts 132 may be spaced apart rings of conductive material molded into housing 128.

A proximity target, such as a conductive surface 140 formed on the exterior of eService transmitter 104, is selectively engageable with the electrical contacts 132 to complete a circuit between the electrical contacts 132 and thereby permit the proximity sensor to detect the repositioning of the eService transmitter 104 in the bore 130. In one possible configuration, eService transmitter 104 may be formed of a dielectric material and conductive surface 140 may be formed from a conductive foil or coating applied to the exterior surface of eService transmitter 104 or a conductive ring molded into eService transmitter 104.

As best shown in FIG. 6, switch plate 116 is slidably mounted to at least one guide rod 146. An end 148 of guide rod 146 can be fixedly attached to housing 128. An opposite end of guide rod 146 may include stop 150, which can be sized larger than the guide rod to prevent switch plate 116 from traveling past the stop. A biasing member 152 may be disposed between housing 128 and switch plate 116 to urge switch plate 116 toward stop 150.

Service switch 124 further includes at least one host actuating link 154 fixedly attached to switch plate 116 at one end 156 of actuating link 154. Actuating link 154 extends from switch plate 116 through aperture 160 in housing 128 and has a hook-shaped portion 158 disposed at its distal end outside of the housing 128. Hook-shaped portion 158 allows actuating link 154 to selectively connect to a device actuating link 174, described below, associated with accessory device 14. Sufficient clearance is provided between host actuating link 154 and aperture 160 to allow host actuating link 154 to move freely in and out of housing 128 and thereby move switch plate 116 to move eService transmitter 104 along aperture 138. Host actuating link 154 may be constructed of a flexible material having a relatively high modulus of elasticity, such as spring steel, or another generally flexible material having similar mechanical properties.

Device eService connector component 22 may include at least one device actuating link 174 that may be connected to host actuating link 154 of host eService connector component 20 when accessory device 14 is coupled to host 12. Device actuating link 174 may include a hook-shaped portion 176 that can be coupled to the correspondingly hook-shaped potion 156 of host actuating link 154. An opposite end 179 of device actuating link 174 can be operably connected to a toggle switch 180, or similar device. Toggle switch 180 can be moved between a latched position and an unlatched position. Toggle switch 180 is illustrated in the unlatched position in FIGS. 6 and 7, and in the latched position in FIG. 8.

Referring generally to FIGS. 4 and 6, it will be appreciated that host eService connector component 20 and device eService connector component 22 may include various geometric features to facilitate coupling of accessory device 14 to host 12. For example, host eService connector component 20 may include a raised boss 190 that can engage a corresponding recess 192 of device eService connector component 22. A raised ridge 184 at least partially defines an outer circumference of recess 192. Alignment features such as raised boss 190 and recess 192 may assist with positioning of device eService connector component 22 relative to host eService connector component 20 prior to engagement, and may also function to minimize lateral movement of accessory device 14 relative to host 12 when device eService connector component 22 is coupled to host eService connector 20. It shall be appreciated, however, that the illustrated configuration is merely one example of the type of features that may be incorporated into host eService connector component 20 and device eService connector component 22 to aide alignment and coupling of accessory device 14 to host 12. In practice, other configurations may also be employed to accommodate various design considerations of a particular application.

Referring generally to FIGS. 6 through 8, to facilitate coupling and decoupling of device actuating link 174 with host actuating link 154, device actuating link 174 can be offset laterally relative to host actuating link 154 to allow hook-shaped portion 176 of device actuating link 174 to clear hook-shaped portion 158 of the host actuating link 154 when accessory device 14 is attached to host 12. For example, referring particularly to FIG. 6, with accessory device 14 positioned for engagement with host 12, hook-shaped portion 158 of host actuating link 154 is initially offset from hook-shaped portion 176 of device actuating link 174. As device eService connector component 22 is moved into engagement with host eService connector component 20, as shown in FIG. 7, hook-shaped portion 158 of host actuating link 154 engages an outer surface 182 of ridge 184 extending from housing 164. Surface 182 is inclined relative to an engagement path denoted by arrow 186. Arrow 186 depicts a path along which accessory device 14 can be moved when coupling and decoupling accessory device 14 to and from host 12. Further movement of device eService connector component 22 toward host eService connector component 20 causes hook-shaped portion 158 of host actuating link 154 to travel along inclined surface 86, which in turn causes hook-shaped portion 158 of host actuating link 154 to be displaced toward hook-shaped portion 176 of device actuating link 174. With device eService connector component 22 fully engaged with host eService connector component 20 (see FIG. 8), hook-shaped portion 158 of host actuating link 154 is sufficiently displaced from its decoupled position, as shown in FIG. 7, so as to axially overlap hooked-shaped portion 154 of device actuating link 174. Moving toggle switch 180 from the unlatched to the latched position retracts device actuating link 174, as shown in FIG. 8.

The process is reversed when disengaging accessory device 14 from host 12. As device eService connector component 22 is disengaged from host eService connector component 20, hook-shaped portion 158 of host actuating link 154 slides along inclined surface 86 and is moved out of alignment with hooked-shaped portion 176 of device actuating link 174, as shown in FIG. 6. Moving toggle switch 180 from the latched position to the unlatched position causes device actuating link 174 to be extended. Device actuating link 174 may be constructed of a similar material as host actuating link 154.

Referring to FIGS. 6-8, the process of coupling and decoupling accessory device 14 with host 12 will now be described.

Coupling of accessory device 14 to host 12 can be accomplished by positioning accessory device 14 adjacent host 12 in such a manner that device eService connector component 22 is generally aligned with host eService connector component 20, as shown in FIG. 6. Device eService connector component 22 and host eService connector component 20 can be coupled together by generally moving accessory device 14 toward host 12 along the path indicated by arrow 186 until the two members are fully seated, as shown in FIG. 7. With device eService connector component 22 fully engaging host eService connector component 20, end 178 of eService receiver 120 aligns with end 110 of eService transmitter 104. However, since switch plate 116 has not yet been activated, the eService communication path between accessory device 14 and host 12 remains incomplete and the supply of eService to eService transmitter 104 may be prevented by the power supply and controller 102.

Transmission of eService to switch plate 116 can be activated by moving toggle switch 180 to the latched position, as shown in FIG. 8. Doing so causes hook-shaped portion 176 of device actuating link 174 to engage hook-shaped portion 158 of host actuating link 154, which in turn results in host actuating link 154 being pulled toward accessory device 14 by device actuating link 174. Switch plate 116 and eService transmitter 104 is pulled along with device actuating link 174 and host actuating link 154 towards housing 164, causing end 178 of eService receiver 120 to engage with end 110 of eService transmitter 104, effectively completing the formation of an eService communication path between accessory device 14 and host 12.

Furthermore, as eService transmitter 104 is advanced into engagement with eService receiver 120, the proximity sensor, represented by electrical contacts 132 on the inner walls of bore 130, is engaged by the proximity target, represented by the conductive surface 140 on the outer walls of the bore 130, to complete a circuit and provide a signal to the power supply and controller 102 to permit the flow of eService from the eService provider 100.

It should be noted that transmission of eService to switch plate 116 can be configured to selectively regulate the flow of eService from the eService provider 100 to the eService transmitter 104 based on the presence of a proximity target associated with the conduit 130 or the switch plate 116 by a proximity sensor associated with the housing 128, and that alternative sensors and targets may be used for this purpose. It should further be noted that the proximity sensor is intended to deliver a signal or message selectively regulating the flow of eService to eService transmitter 104 and that the configuration represented in the drawings and described above as being created through the completion of an electrical circuit is merely one example of various signals or messages that may be used for this purpose. It should also be noted that additional switches and controls, besides those represented in the drawings and described herein, may be provided to further regulate the flow of eService based on the needs of the user of the accessory device 14.

Accessory device 14 can be decoupled from host 12 by reversing the previously described process for coupling the two together. For example, service switch 124 can be moved to the open position by cycling toggle switch 180 from the closed position, shown in FIG. 8, to the open position, shown in FIG. 7. Doing so extends device actuating link 174 and allows biasing member 152 to move switch plate 116 toward stop 150 of guide rod 146. Switch plate 116 eventually contacts stop 150. Further movement of switch plate 116 away from receptacle 142 causes end 110 of eService transmitter 104 to disengage end 178 of eService receiver 120, thereby interrupting the eService communication path between accessory device 14 and host 12 (see FIG. 7). Switch plate 116 stops moving upon contacting stop 150 of guide rod 146. Once toggle switch 180 has been moved to the unlatched position, accessory device 14 can be removed from host 12 by withdrawing accessory device 14 from host 12 along a path generally parallel to arrow 186. Furthermore, as eService transmitter 104 is retracted from engagement with eService receiver 120, the proximity sensor acts to discontinue the signal to power supply and controller 102, thereby selectively modifying the operation of eService provider 100 or discontinuing power thereto.

Figure 9:
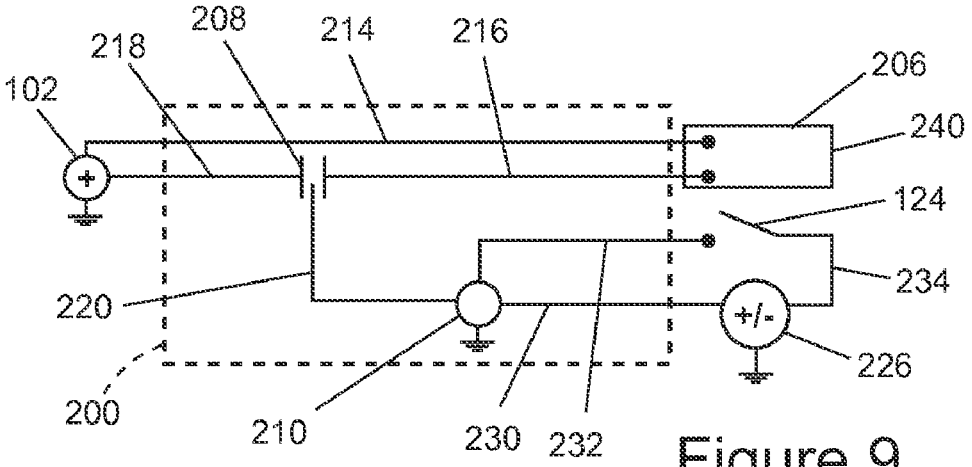
FIG. 9 schematically illustrates a thermal eService provider.
Figure 10:
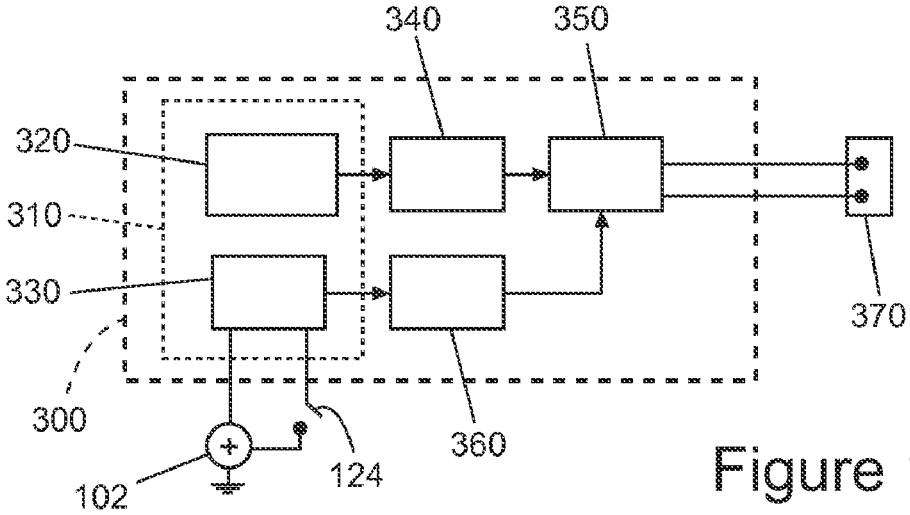
FIG. 10 schematically illustrates an acoustical eService provider.
Figure 11:
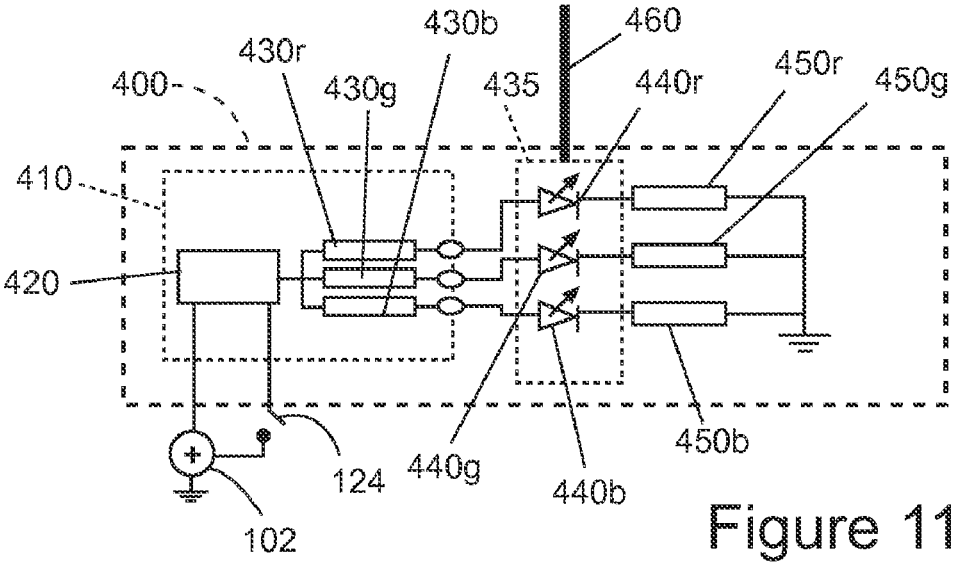
FIG. 11 schematically illustrates an illumination eService provider.

Referring now to FIGS. 9, 10 and 11, other embodiments of eService providers are illustrated schematically. FIG. 9 shows thermal service provider 200. FIG. 10 shows acoustic service provider 300, FIG. 11 shows illumination service provider 400.

As shown in FIG. 9, thermal service provider 200 may include a heat generator 206 and contacts 208 of a relay 210 for switching power to the heat generator connected in series with power supply 102. Heat generator 206 may produce or pass on current to heat a transformer, such as a resistance-type heater (not shown) using electrical resistance to generate heat from current flowing thorough heat generator 206. Power supply 102 is selected to have a high wattage output sufficient to enable heat generator 206 to generate a desired level of heat.

More particularly, a first side of power supply 102 is connected by a power line 214 to a first side of heat generator 206, a second side of heat generator 206 is connected by a power line 216 to a first side of contacts 208, and a second side of contacts 208 is connected by a power line 218 to a second side of power supply 102.

Relay 210 is connected to contacts 208 by a mechanical coupling 220 operable to selectively complete the circuit between power supply 102 and heat generator 206. Relay 210 is connected in series with a low wattage power supply 226 and service switch 124, described previously with reference to FIGS. 6 through 8. More particularly, a first side of low wattage power supply 226 is connected by a power line 230 to a first side of relay 210, a second side of relay 210 is connected by a power line 232 to a first side of service switch 124 and a second side of service switch 124 is connected by a power line 234 to a second side of low wattage power supply 226. Thus, when service switch 124 is closed, as described above with reference to FIGS. 6 and 7, relay 210 is powered by low wattage power supply 226.

Mechanical coupling 220 may include a plunger (not shown), which moves according to the attractive magnetic forces created by the current flowing through the coil of relay 210. The plunger is mechanically coupled to high current contacts 208 with power lines 218 and 216 such that when the plunger moves in response to the current flow, the high current contacts are mechanically brought into electrical communication. Thus, relay 210 actuates to close contacts 208 to permit the flow of current to heat generator 206. It will be appreciated that there may be additional switches and logic regulating the supply of power from high wattage power supply 102 to heat generator 206, and contacts 208 may act as one of a plurality of switches that must be closed before heat generator 206 is powered.

The heat generator 206 includes a heat conductive surface 240 capable of communicating heat to another device. Thus heat generator 206 may be coupled with or may comprise a thermal eService transmitter 104 (see FIGS. 6-8), which may transmit thermal energy to a thermal eService receiver 120. The eService transmitter 104 may conduct the heat when the current to heat transformer 206 generates heat.

As shown in FIG. 10, acoustic service provider 300 may include a microprocessor 310 having an input circuit connected with power supply 102 through service switch 124. When service switch 124 closes, the input of the microprocessor 310 changes state, thereby informing the logic of the microprocessor 310 that service switch 124 is closed.

Microprocessor 310 includes a sound source 320, which may be a sound generator or a sound processor connected to an external source of sound data in any digital or analog format. Microprocessor 310 further includes logic 330 for controlling the operation of the acoustical service provider 300. The output of sound source 320 is delivered, for example, through a digital-to-analog converter 340, which in turn delivers an electrical sound wave input to an amplifier 350.

Logic 330 is configured to respond to the information regarding the status of service switch 124 by enabling another digital-to-analog converter 360 to send a control analog signal to amplifier 350, which controls the level of the signal output of the amplifier, thereby effectively operating as an acoustic switch. Amplifier 350 receives the electrical sound input wave from sound source 320 and creates an amplified electrical sound output wave having an amplitude determined by the electrical sound input wave and the level of amplification indicated by the analog signal.

The sound output wave is then received by a speaker 370, which is coupled to the output of amplifier 350 and converts the output into a sound wave, which can be transmitted to an eService receiver, such as a microphone (not shown). Speaker 370 thereby serves as an eService transmitter.

As shown in FIG. 11, illumination service provider 400 may include a microprocessor 410 having an input circuit connected with power supply 102 through service switch 124. When service switch 124 closes, the input of microprocessor 410 changes state, thereby informing logic 420 of the microprocessor 410 that service switch 124 is closed. The logic 420 of microprocessor 410 is configured to respond to this information by allowing the logic 420 to determine the color and intensity of the light to be created by illumination service provider 400 in a manner described below.

Microprocessor 410 includes three pulse-width modulation (PWM) modules 430*r*, 430*g* and 430*b*, which can create PWM electrical signals. Each PWM module 430*r*, 430*g*, and 430*b* is associated with a particular output circuit of microprocessor 410. The output of each PWM module 430*r*, 430*g* and 430*b* is connected to one of three LEDs: red LED 440*r*, green LED 440*g* and blue LED 440*b*. The output of each LED 440*r*, 440*g* and 440*b* is combined and directed to a light pipe 460, which serves as an illumination eService transmitter. Each LED 440*r*, 440*g* and 440*b* is connected to ground through a resistor 450*r*, 450*g* and 450*b*.

The color transmitted from the light pipe 460 is determined by the relative proportions of the light each LED 440*r*, 440*g* and 440*b* generates. In particular, logic 420 controls each PWM module 430*r*, 430*g* and 430*b* such that each LED 440*r*, 440*g* and 440*b* receives a signal for a portion of time. Each LED 440*r*, 440*g* and 440*b* emits light at a magnitude proportional to the portion of time that the signal is received. A resultant color is created by the relative contribution of emitted light each LED 440*r*, 440*g* and 440*b*. Therefore, the resultant color output is controlled by the logic that controls the portion of time each PWM module 430*r*, 430*g* and 430*b* is sending the signal.

The intensity of the resultant color light transmitted from the LEDs 440*r*, 440*g* and 440*b* to light pipe 460 is also a proportional sum of the portions of time each PWM module 430*r*, 430*g* and 430*b* is sending the signal.

Therefore, the color and intensity of the resultant light provided to light pipe 460 may be controlled by logic 420 in response to actuation of the service switch 124 by controlling the intensity of the light emitted by each of the LEDs relative to one another and the absolute intensity of the light emitted by all of the LEDs.

Figure 12:
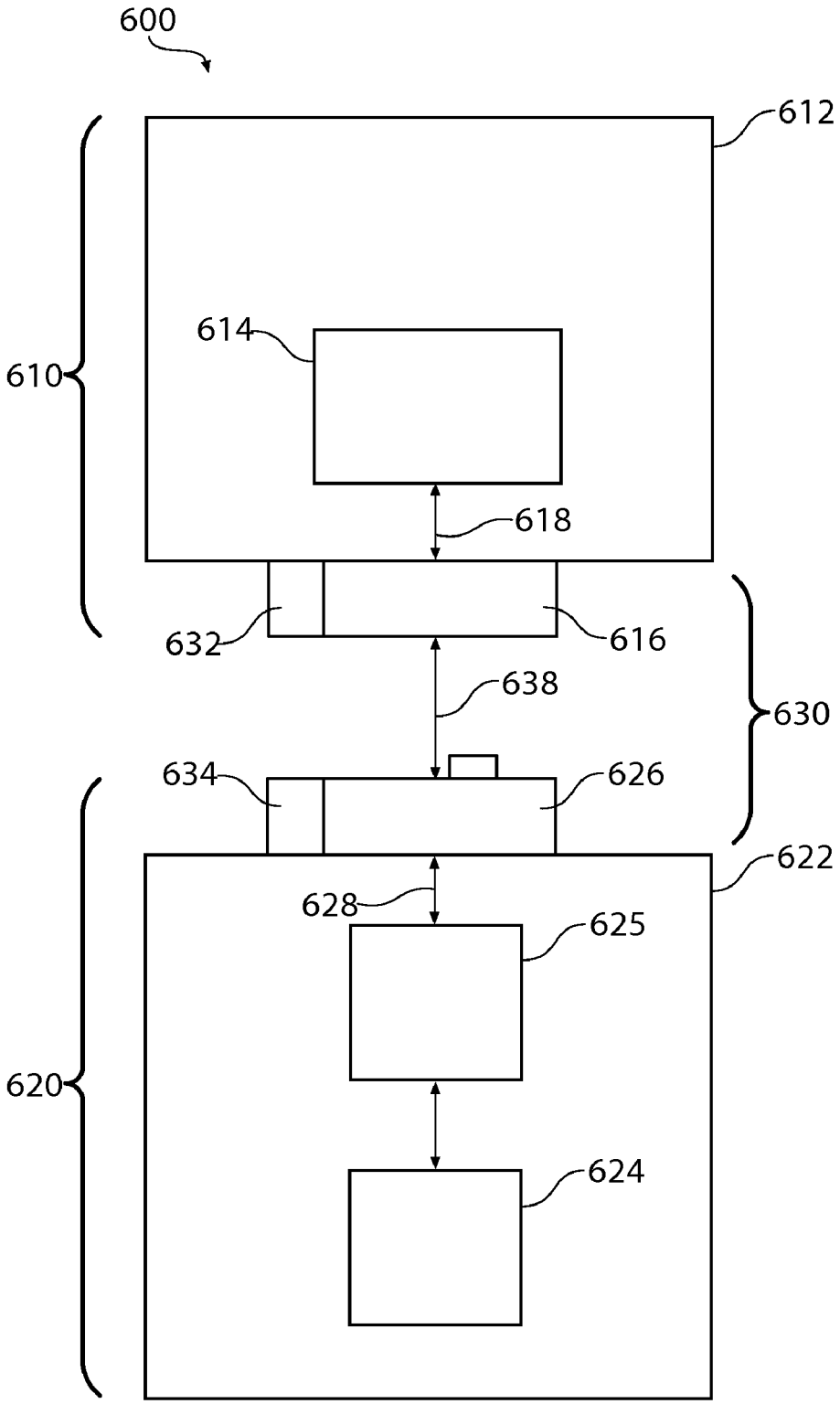
FIG. 12 schematically illustrates an eService provider and consumption system 600.

Referring now to FIG. 12 a more general example of an eService provider and consumption system 600 is schematically illustrated. A first subsystem 610 is connectable to a second subsystem 620 for selectively transferring an eService between the subsystems 610 and 620. As illustrated, first subsystem 610 may include an accessory device 612, such as a portable device, having an eService consumer 614 connected to a plug 616 by an eService line 618. Second subsystem 620 may include a host 622, such as a refrigerator, having an eService provider 624 connected to a receptacle 626 through a switch 625 by eService lines 628.

A connector system 630 includes plug 616 and receptacle 626 which are selectively interengageable. Switch components 632 and 634 are respectively associated with the plug 616 and the receptacle 626 to selectively activate the switch 625 when the plug and receptacle are engaged to permit the flow of the eService from the eService provider 624 to the receptacle 626, then along an eService line 638 between receptacle 626 and plug 616, and then along eService line 618 to eService consumer 614.

It will be appreciated that while host 622 is illustrated as including eService provider 624 and accessory device 612 is illustrated as including eService consumer 614, accessory device 612 may alternatively or additionally include an eService provider and host 622 may alternatively or additionally include an eService consumer. It will further be appreciated that while plug 616 is illustrated as being associated with eService consumer 614 and receptacle 626 is illustrated as being associated with eService provider 624, it is contemplated that plug 616 and receptacle 626 may be male or female connector components so long as the components are capable of interengaging to permit the transfer of eService therebetween.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In summary, it should be understood that the invention is capable of modification and variation and is limited only by the following claims.

All defined terms used in the claims are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A system for coupling with a first eService communicating device having a first eService connector component, the system comprising:

a second eService connector component connectable to the first eService connector component;

a service switch operably connected to an eService source, the service switch operable for selectively communication an eService between the first and second eService connector components;

a first actuating link moveably associated with the service switch;

a second actuating moveably associated with the second eService connector component and engageable with the first actuating link; wherein the second actuating link is moveable between an extended position and a retracted position, wherein the service switch is activated to transfer the eService between the first and second eService connector components when the second actuating link is in the retracted position;

an eService communicating component for selectively communicating the eService with the second eService connector component, the eService communicating component being moveable between a first position in which the first and second eService connector components are operably coupled and a second position in which the first and second eService connector components are operable decoupled, wherein the eService communicating component is arranged in second position when the first eService connecting component is decoupled from the second eService connecting component; and a biasing member connected to the eService communicating component, the biasing member operable for urging the eService communicating component toward the second position.

2. The system according to claim 1, wherein the eService communicating component is selected from a transmitter and a receiver.

3. A system for coupling with a first eService communicating device having a first eService connector component, the system comprising:

an eService source;

a second eService connector component connectable to the first eService connector component;

a service switch operably connected to the eService source, the service switch operable for selectively communicating an eService between the first and second eService connector components;

a first actuating link moveable associated with the service switch;

a second actuating link moveably associated with the second eService connector component and engageable with the first actuating link, wherein the second actuating link is moveable between an extended position and a retracted position, wherein the service switch is activated to transfer the eService between the first and second eService connector components when the second actuating link is the retracted position; and an eService pathway coupled to the eService source for selectively transferring the eService between the eService source and the second eService connector component, the eService pathway being connected to the first actuating link for concurrent movement therewith, wherein the eService pathway is operably coupled to the second eService connector component when the second actuating link is the retracted position;

wherein the eService pathway is operably decoupled from the second eService connector component when the second actuating link is in the extended position.

4. The system according to claim 3 and further comprising a housing, wherein the second eService connector component includes an exposed end enclosed within the housing and operably engageable with the eService pathway, and an eService receiver accessible from outside of the housing.

5. The system according to claim 3, further comprising the eService source and further wherein the service switch is deactivated to substantially block transmission of the eService from the eService source to the second eService connector component when the first actuating link is detached from the second actuating link.

6. The system according to claim 5, wherein the service switch is deactivated to substantially block transmission of the eService from the eService source to the second eService connector component when the second eService connector component is decoupled from the first eService connector component.

7. The system according to claim 5, further comprising a host configured to communicate at least one eService with the first eService communicating device.

8. The system according to claim 7, wherein the host comprises at least one of a refrigerator, a freezer, a conventional oven, a microwave oven, a dishwashing machine, a stove, a range, an air conditioner, a dehumidifier, a clothes washing machine, a clothes dryer, a clothes refreshing machine, a non-aqueous washing apparatus, a water softener, a water heater, a furnace, pool water treatment equipment, an HVAC system, a thermostat, a blender, a mixer, a toaster, a coffee maker, a trash compactor, an air purifier, an iron, a vacuum cleaner, a robot, and a structural feature of a building.

9. The system according to claim 7 and further comprising an eService consumer configured to communicate at least one eService with the host.

10. A system for receiving an eService consumer comprising an eService connector, the system comprising:

a first eService connector component operably engageable with a separate second eService connector component for transferring an eService from an eService source to the second eService connector component;

a service switch for selectively connecting the first eService connector component to the eService source, the service switch including a first actuating link engageable with a second actuating link associated with the second eService connector component, wherein the service switch is activated to transfer an eService from the eService source to the first eService connector component in response to movement of the second actuating link associated with the second eService connector component;

an eService line operably connected to the eService source and to the first actuating link, wherein the eService line is moveable between a first position in which the eService line is operably coupled to the first eService connector component for transferring the eService from the eService source to the first eService connector component in response to movement of the first actuating link, and a second position in which the eService line is operably uncoupled from the first eService connector component; and a biasing member connected to the eService line for urging the eService line toward the second position.

11. The system according to claim 10, wherein the first eService connector component includes an eService transmitter enclosed within a housing and selectively engageable with the eService line, and an exposed end accessible from outside the housing, the exposed end being engageable with the second eService connector component.

12. The system according to claim 10 and further comprising the eService source for supplying the eService to the second eService connector component.

13. The system according to claim 10, wherein the eService line is enclosed within a housing, and at least a portion of the first actuating link extends outside of the housing.

14. The system according to claim 10, wherein at least a portion of the first eService connector component and the first actuating link are accessible from outside a housing enclosing the eService line.

15. The system according to claim 10, wherein the first actuating link is moveable between an extended position in which the eService line is operably coupled to the first eService connector component, and a refracted position in which the eService line is operably uncoupled from the first eService connector component.

16. The system according to claim 10, wherein the eService comprises at least one of a thermal service, an acoustical service and an illumination service.

17. The system according to claim 10, further comprising a host configured to communicate the eService to an eService consumer.

18. The system according to claim 17, wherein the host is one of a refrigerator, a freezer, a conventional oven, a microwave oven, a dishwashing machine, a stove, a range, an air conditioner, a dehumidifier, a clothes washing machine, a clothes dryer, a clothes refreshing machine, a non-aqueous washing apparatus, a water softener, a water heater, a furnace, pool water treatment equipment, an HVAC system, a thermostat, a blender, a mixer, a toaster, a coffee maker, a trash compactor, an air purifier, an iron, a vacuum cleaner, a robot, and a structural feature of a building.

19. An eService communicating device for receiving an eService from a host comprising a first eService connector component, the eService communicating device comprising:

a second eService connector component operably engageable with the first eService connector component for selectively receiving an eService from an eService source; and an actuator operably associated with the second eService connector component, the actuator moveable between at least a first position and a second position along a path generally parallel to an axis of insertion of the second eService connector component with the first eService connector component, wherein the actuator comprises:

at least one actuating link engageable with a corresponding actuating link associated with the first eService connector component, the actuating link being moveable between an extend position and a retracted position; and a switch operably connected to the at least one actuating link, the switch selectively moveable between a latched position for positioning the at least one actuating link in the retracted position, and an open position for positioning the at least one link in the extended position;

wherein the eService is delivered to the second eService connector component when the actuator is in the first position and wherein a longitudinal axis of the at least one actuating link is aligned substantially parallel to the axis of insertion.

20. The eService communicating device according to claim 19, wherein the at least one actuating link includes a hook-shaped end engageable with the corresponding actuating link.

21. The eService communicating device according to claim 19, wherein the at least one actuating link comprises at least two actuating links and the second eService connector component is disposed between the at least two actuating links.

22. The eService communicating device according to claim 19 and further comprising an eService consumer in communication with the second eService connector component.

23. The eService communicating device according to claim 22 wherein the eService consumer is at least one of an accessory device, a client software device, a remote user interface, a source of consumer information, a reader, a sensor device, a smart utensil, a portable appliance, an additional smart coupling device, a remote controller, a network binder, a cycle accessory, a resource controller, a communicator, an access system, a payment system, a sales demonstration device, a consumable holder, a dispenser, a filter, a water filter, an air filter, a detergent dispenser, a drink dispenser, a media content holder, and an eService device.

24. The eService communicating device according to claim 19, wherein the eService comprises at least one of an acoustic service, a thermal service and an illumination service.

25. An eService communicating device for receiving an eService from a host comprising a first eService connector component, the eService communicating device comprising:

a second eService connector component operably engageable with the first eService connector component for selectively receiving an eService from an eService source; and an actuator operably associated with the second eService connector component, the actuator moveable between at least a first position and a second position along a path generally parallel to an axis of insertion of the second eService connector component with the first eService connector component; wherein the actuator comprises:

at least one actuating link engageable with a corresponding actuating link associated with the first eService connector component, the actuating link moveable between an extended position and a retracted position; and a switch operably connected to the at least one actuating link, the switch selectively moveable between a latched position for positioning the at least one actuating link in the retracted position, and an open position for position the at least one link in the extended position;

wherein the eService is delivered to the second eService connector component when the actuator is in the first position, and wherein the at least one actuating link is moveable substantially parallel to a longitudinal axis of the at least one actuating link.

26. The eService communicating device according to claim 25, wherein the at least one actuating link includes a hook-shaped end engageable with the corresponding actuating link.

27. The eService communicating device according to claim 25, wherein the at least one actuating link comprises at least two actuating links and the second eService connector component is disposed between the at least two actuating links.

28. The eService communicating device according to claim 25 and further comprising an eService consumer in communication with the second eService connector component.

29. The eService communicating device according to claim 28 wherein the eService consumer is at least one of an accessory device, a client software device, a remote user interface, a source of consumer information, a reader, a sensor device, a smart utensil, a portable appliance, an additional smart coupling device, a remote controller, a network binder, a cycle accessory, a resource controller, a communicator, an access system, a payment system, a sales demonstration device, a consumable holder, a dispenser, a filter, a water filter, an air filter, a detergent dispenser, a drink dispenser, a media content holder, and an eService device.

30. The eService communicating device according to claim 25, wherein the eService comprises at least one of an acoustic service, a thermal service and an illumination service.

31. An adapter for removably coupling an accessory having a first accessory eService connector component to a host having an eService provider, a first host eService connector component, and a service switch selectively providing an eService to the first eService connector, the adapter comprising:

a second host eService connector component engageable with the first host eService connector component;

a second accessory eService connector component engageable with the first accessory eService connector component;

an eService line operably interconnecting the second host eService connector component and the second accessory eService connector component for the transfer of an eService therealong; and a first actuating link engageable with a second actuating link associated with the service switch, wherein movement of the first actuating link activates the service switch.

32. The adapter according to claim 31, wherein the first actuating link engages the second actuating link associated with the service switch when the second host eService connector component engages the first host eService connector.

* * * * *